US008567999B2

(12) United States Patent
Paik et al.

(10) Patent No.: US 8,567,999 B2
(45) Date of Patent: Oct. 29, 2013

(54) LIGHTING APPARATUS

(75) Inventors: Dongki Paik, Seoul (KR); Hyunha Kim, Seoul (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 13/049,776

(22) Filed: Mar. 16, 2011

(65) Prior Publication Data

US 2011/0317412 A1 Dec. 29, 2011

(30) Foreign Application Priority Data

Jun. 23, 2010 (KR) ..... 10-2010-0059579

(51) Int. Cl.

| | |
|---|---|
| ***F21V 15/00*** | (2006.01) |
| ***F21V 7/00*** | (2006.01) |
| ***F21V 17/00*** | (2006.01) |
| ***F21S 6/00*** | (2006.01) |

(52) U.S. Cl.
USPC ..... 362/362; 362/257; 362/296.01; 362/364; 362/365

(58) Field of Classification Search
USPC ..... 362/257, 296.01, 362, 364, 365
See application file for complete search history.

(56) References Cited

U.S. PATENT DOCUMENTS

| | | | | |
|---|---|---|---|---|
| 6,168,295 | B1 * | 1/2001 | Hein et al. | 362/308 |
| 6,530,581 | B2 * | 3/2003 | Lai | 280/11.203 |
| 7,222,989 | B2 * | 5/2007 | Zhou | 362/257 |
| 7,494,252 | B1 * | 2/2009 | Thornton et al. | 362/294 |
| 7,527,397 | B2 * | 5/2009 | Li | 362/294 |
| 7,575,339 | B2 * | 8/2009 | Hung | 362/230 |
| 7,635,206 | B2 * | 12/2009 | Huang | 362/296.01 |
| 7,674,015 | B2 * | 3/2010 | Chien | 362/294 |
| 7,682,051 | B2 * | 3/2010 | Xiao et al. | 362/364 |
| 2007/0223230 | A1 * | 9/2007 | Trojanowski et al. | 362/294 |
| 2007/0236935 | A1 * | 10/2007 | Wang | 362/294 |
| 2008/0084701 | A1 * | 4/2008 | Van De Ven et al. | 362/373 |
| 2008/0089071 | A1 * | 4/2008 | Wang | 362/294 |
| 2008/0123341 | A1 * | 5/2008 | Chiu | 362/294 |
| 2008/0232124 | A1 * | 9/2008 | Tsukamoto et al. | 362/487 |
| 2009/0003009 | A1 * | 1/2009 | Tessnow et al. | 362/487 |
| 2009/0097262 | A1 * | 4/2009 | Zhang et al. | 362/364 |
| 2009/0168437 | A1 * | 7/2009 | Isac | 362/362 |

FOREIGN PATENT DOCUMENTS

| | | |
|---|---|---|
| JP | 3134602 | 8/2007 |
| KR | 20-0302769 | 1/2003 |
| KR | 10-2008-0083006 | 9/2008 |

OTHER PUBLICATIONS

Korean Notice of Allowance dated Jun. 17, 2013.

* cited by examiner

*Primary Examiner* — Jong-Suk (James) Lee
*Assistant Examiner* — Bryon T Gyllstrom
(74) *Attorney, Agent, or Firm* — KED & Assoociates, LLP

(57) ABSTRACT

A lighting apparatus as disclosed herein may include an installation guide plate which may guide the installation of a light source module inside a housing of the lighting apparatus. The guide plate may include an opening shaped to correspond to a shape of the light source module. The light source module may be inserted into the opening to facilitate positioning and installation of the light source module. The guide plate may also be configured to provide electrical insulation between the light source module and the housing.

14 Claims, 6 Drawing Sheets

LIGHTING APPARATUS

CROSS-REFERENCE TO RELATED APPLICATION(S)

Pursuant to 35 U.S.C. §119(a), this application claims the benefit of earlier filing date and right of priority to Korean Patent Application No. 10-2010-0059579, filed in Korea on Jun. 23, 2010, the contents of which are hereby incorporated by reference herein in their entirety.

BACKGROUND

1. Field

A lighting apparatus is disclosed herein.

2. Background

Lighting apparatuses are known. However, they suffer from various disadvantages.

BRIEF DESCRIPTION OF THE DRAWINGS

The embodiments will be described in detail with reference to the following drawings in which like reference numerals refer to like elements, wherein.

DETAILED DESCRIPTION

Figure 1:
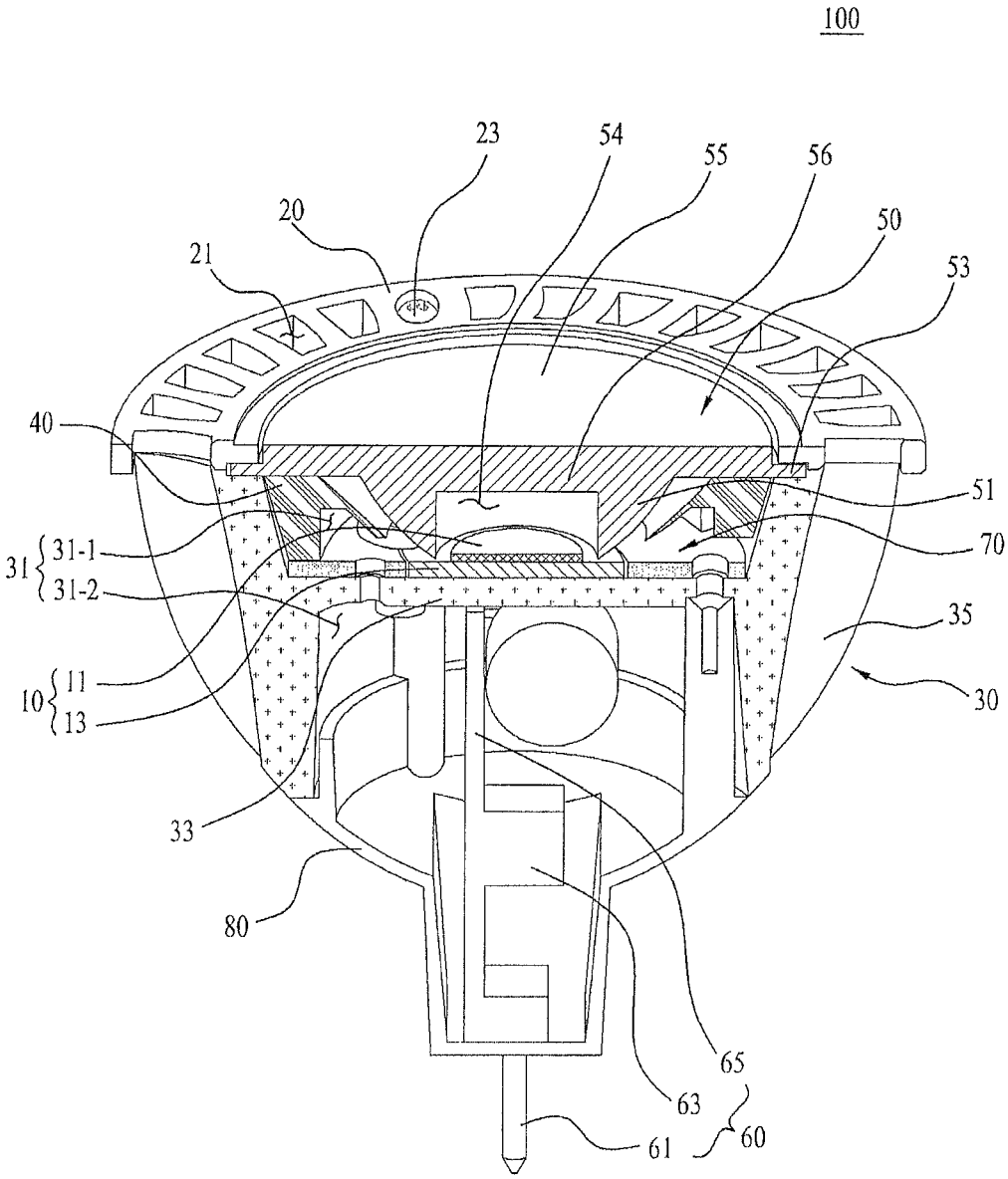
FIG. 1 is a cross-sectional view of a lighting apparatus according to an embodiment of the present disclosure.

The present application or patent relates to a lighting apparatus which may produce diffused light to illuminate a large area or directional light to illuminate a particular object or a prescribed area. More particularly, the present disclosure relates to a lighting apparatus in which a light source having a light emitting element may be easily fastened to a body of the lighting apparatus and may be electrically connected to an electric unit while having enhanced electrical insulation.

Simply for ease of discussion, the lighting apparatus of the present disclosure describes a light emitting diode (LED) as being the lighting emitting element. However, it should be appreciated that the present disclosure is not limited thereto, and various types of light emitting elements may be applicable to the disclosed lighting apparatus.

Various types of lighting apparatuses, such as incandescent lights, fluorescent lights, halogen lamps, etc., may be used for illumination. Lighting apparatuses that employ LEDs as a light source may be used in place of filament type lights, fluorescent bulbs, halogen lamps, or other appropriate types of light sources. These LED based lighting apparatuses may be used as a general lighting apparatus for use in homes or offices.

LEDs may be designed to emit light via carrier injection and recombination at p-n junctions of semiconductors. Such LEDs may have a smaller size and longer lifespan than conventional light sources, and may exhibit high illumination efficiency with lower power consumption by directly converting electrical energy into light. LEDs may also have a rapid response time, thus allowing for application in, for example, display devices in vehicles, optical communication appliances, or lamps or display devices in a variety of electronic appliances.

Examples of lighting apparatuses which may use LEDs as a light source may include an LED street lamp, a bulb type LED lamp, a bar type LED lamp, a tube type LED lamp, a downlight type LED lamp, a flat panel display device, an LED sign channel module, or another appropriate type of light source. All such lighting apparatuses are collectively referred to herein as an LED lighting device or LED lighting apparatus. Simply for ease of discussion, the lighting apparatus will be described herein as a lamp type lighting apparatus by way of example.

An LED lighting apparatus may be configured as an LED package in which one or more LEDs are mounted on a printed circuit board. is the LED package may be mounted to a body of the lighting apparatus. The lighting apparatus as embodied and broadly described herein may allow the LED package to be more easily mounted to the body of the lighting apparatus.

In addition, the body of the LED lighting apparatus may be configured as a heat sink. The body may be formed of a thermally conductive material, such as metal, to effectively dissipate heat away from the LED. Moreover, an electrode may be soldered to the LED package to electrically connect the LED package to an LED drive unit via an electrical wire. Because the size of the LED package may be small, a faulty solder joint may be common during assembly. In this case, the faulty solder joint may cause an unintentional electrical connection between the electrode of the LED package and the metallic heat sink, resulting in a risk of electric shock. The lighting apparatus as disclosed herein may prevent such short circuits, for example, even when faulty solder joints are present.

FIG. 1 is a cross-sectional view of the lighting apparatus according to an embodiment of the present disclosure. As illustrated in FIG. 1, the lighting apparatus 100 according to this embodiment may include a light source module 10 (light source), a front ring 20 (cover ring), a body 30, a reflector 40 (reflecting member), lens 50 (lens unit), and a base 80. The light source module 10 (light source) may include a light emitting element 11 (e.g., an LED) that emits light. The body 30 may include a cavity 31 (receiving space) defined therein and a mounting plate 33 (seating plane portion) which may divide the cavity 31 into an upper cavity 31-1 (upper region) and a lower cavity 31-2 (lower region). Moreover, the light source module 10 may be mounted on the mounting plate 33 inside the upper cavity 31-1, and an electric unit 60 may be positioned in the lower cavity 31-2 of the cavity 31.

The light source module 10 may include at least one LED 11 and a circuit board 13 on which the LED 11 may be mounted. The light source module 10 may also be referred to herein as an LED package. The circuit board 13 may be a printed circuit board (PCB). In the present embodiment, the light source module 10 may be received in an opening on a guide plate 70 (installation guide member) so as to be stably mounted to the body 30. The guide plate 70 may guide the installation and positioning of the light source module 10 on the mounting plate 33, and may also provide electrical insulation between the light source module 10 and the body 30.

The body 30 may include the cavity 31, which may be open as the top and bottom to receive the light source module 10 and the electric unit 60 therein. Also, the body 30 may include the mounting plate 33 that divides the cavity 31 into the upper cavity 31-1 and the lower cavity 31-2. The light source module 10 may be mounted on the mounting plate 33 of the body 30. Thus, the light source module 10 may be positioned in the upper cavity 31-1 of the cavity 31 to emit light from the upper side of the body 30.

As described above, the body 30 may serve as a housing to receive the light source module 10, the electric unit 60 as well as other components of the lighting apparatus in the cavity 31 defined therein. For example, the body 30 may partially enclose the light source module 10 and the electric unit 60. In addition, the body 30 may serve to dissipate heat generated by the LED 11 of the light source module 10 into the atmosphere. In this case, the body 30 may be referred to as a heat sink.

Although the body 30 of FIG. 1 is shown to have a circular transversal cross-section which increases in diameter from the bottom to the top of the body 30, the body 30 of the present disclosure is not limited to this shape. Moreover, the body 30 may be made of a thermally conductive material, such as metal, so as to rapidly conduct and radiate heat emitted from the LED 11. For example, the body 30 may be made of a light weight metal, such as aluminum, to prevent an increase in the weight of the lighting apparatus. Alternatively, the body 30 may be made of thermally conductive plastic. Moreover, the body 30 may include a plurality of radiator fins 35 on an outer surface thereof. The radiator fins 35 may be radially spaced a predetermined distance from one another. The radiator fins 35 are described in detail further detail when reference to FIG. 2 hereinbelow.

The lighting apparatus 100 according to the present disclosure may further include a lens 50 placed on the light source module 10 to redirect light emitted from the light-emitting element 11 to the outside. The lens 50 may be provided in the cavity 31 of the body 30, and may collect light emitted from the LED 11 of the light source module 10 to direct the collected light in a prescribed direction. For example, the lens 50 may be positioned over the light source module 10 in the upper cavity 31-1 of the cavity 31 of the body 30.

The lens 50 may function to capture and redirect light emitted from the LED 11 of the light source module 10. The lens 50 may include a condenser lens 51 that captures the light emitted from the LED 11. The condenser lens 51 may have a reflecting surface which may have a conical, a parabolic, elliptic, hyperbolic shape, or another appropriate shape to provide a desired characteristics of the projected light.

Referring again to FIG. 1, the condenser lens 51 may condense the light emitted from the LED 11 and direct the condensed light out from the lens 50 through the light exit surface 55 (light exit portion). The light emitted from the LED 11 may be directed into a cavity 54 defined in the condenser lens 51. Then, the light may pass through a central lens 56 positioned immediately above the cavity 54, and may be projected through the light exit surface 55.

A portion of the light emitted from the LED 11 may fail to pass through the central lens 56. This portion of light may be refracted into the body of the condenser lens 51 when the light traverses across a surface of the condensing lens 51 from the LED 11. This light may travel through the condenser lens 51 and may be reflected at the outer reflecting surface of the condenser lens 51 towards the light exit surface 55. Moreover, while a substantial amount of light directed towards the light exit surface 55 may exit the lens 50, a portion of this light may be reflected back into the lens 50. This reflected light may be reflected back by the outer reflecting surface of the condenser lens 51 towards the light exit portion 55 to be projected out of the lens 50. As illustrated in FIG. 1 and as previously described, the outer reflecting surface of the condenser lens 51 may have a parabolic conical cross section.

The lens 50 may include a flange 53 by which the lens 50 may be connected to the body 30. The flange 53 may protrude outward from an outer edge of the lens 50. The flange 53 may be seated on a stepped portion formed in the body 30 to laterally hold the lens 50 in place. The lighting apparatus 100 may further include a front ring 20 that may couple the lens 50 to the body 30. The front ring 20 may be positioned adjacent to the flange 53 to hold the lens 50 in place on the body 30. Once the front ring 20 is positioned over the lens 50 to hold it in place, fixing elements 23 may be fastened to couple the front ring 20 to the body 30. The fixing elements 23 may be one of a plurality of types of connectors, including bolts, screws, rivets, or another appropriate type of connector.

The lighting apparatus 100 according to the embodiment of the present disclosure may further include a reflector 40 that reflects light emitted from the light-emitting element 11 in a predetermined direction. The reflector 40 may be provided between the light source module 10 and the lens 50. The reflector 40 may reflect a portion of light emitted from the LED 11 toward the lens 50. For example, light that does not enter the cavity 54 of the condenser lens 51 or which may be reflected or scatter out of the condenser lens 51 may be reflected by the reflector 40 back towards the lens 50. The reflector 40 may also increase an angular range or dispersion of the light that is projected from the lens 50.

The lighting apparatus 100 according to the present disclosure may further include the electric unit 60 that drives and controls the light source module 10. The electric unit 60 may be configured to power the light source module from power received from an external source. The electric unit 60 may be provided in a lower region of the body 30. For example, the electric unit may be provided in the lower cavity 31-2 of the body 30.

The electric unit 60 may include a power connector 61 that may be connected to an external power source, a control element 63 that may control the supply of power from the power connector 61 to the light source module 10, and a control substrate 65 on which the power connector 61 and the control element 63 may be mounted. Here, the control element 63 and the control substrate 65 may be positioned in the body 30 such that it may be shielded from the outside. On the other hand, the power connector 61 may be exposed to the outside of the body 30 to be connected with the external power source.

The lighting apparatus 100 according to the present disclosure may further include a base 80. The base 80 may be positioned at a lower portion of the body 30 such that a portion of the base 80 may be placed inside the lower cavity 31-2 of the body. The electric unit 60 may be placed inside the base 80 and may be thermally insulated from the LED 11 or the body 30. For example, a portion of the electric unit 60 positioned inside the base 80 may be placed inside the lower cavity 31-2 of the heat sink 30. Because the electric unit 60 may be sensitive to heat generated by the LED 11 and radiated by the heat sink 30, the base 80 may be configured to thermally insulate the electric unit 60 provided therein. Hence, a portion of the electric unit 60 positioned inside the heat sink 30 may be shielded from the body 30 by the base 80. The remaining portion of the base 80 may remain exposed outside the body 30. Moreover, a power connector hole may be perforated at the bottom of the base 80 which may expose the power connector 61 of the electric unit 60 to the outside.

Figure 2:
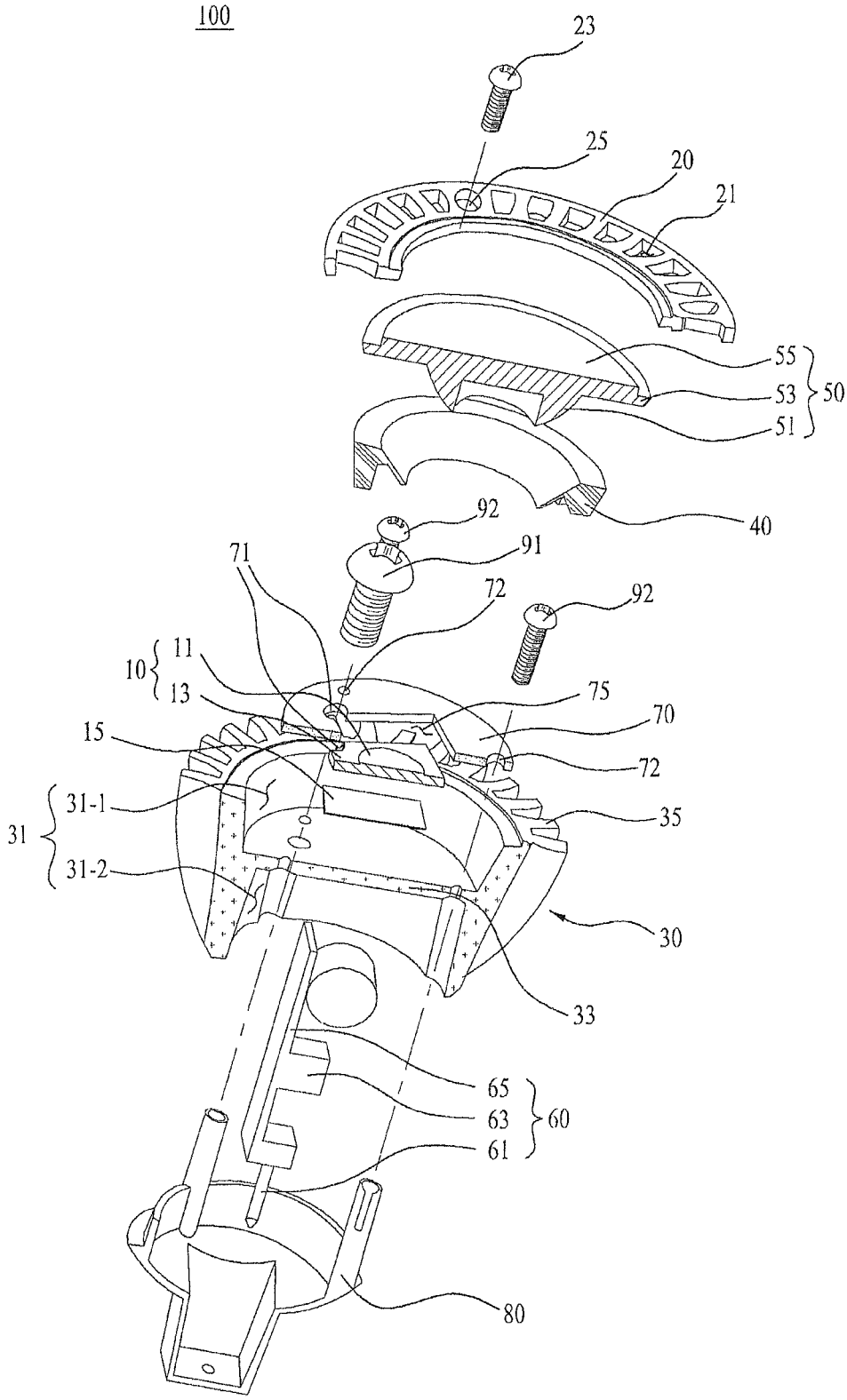
FIG. 2 is an exploded cross-sectional view of the lighting apparatus according to an embodiment of the present disclosure.

FIG. 2 is an exploded cross-sectional view of the lighting apparatus according to an embodiment of the present disclosure. As illustrated in FIG. 2, the lighting apparatus 100 may include a light source module 10 including the LED 11 mounted thereon. A body 30 may include a cavity 31 formed therein, and may include a mounting plate 33 that divides the cavity 31 into the upper cavity 31-1 and the lower cavity 31-2. The light source module 10 may be mounted on the mounting plate 33 in the upper cavity 31-1. The electric unit 60 may be provided in the lower cavity 31-2. Moreover, a guide plate 70 may be mounted on the mounting plate 33. The guide plate 70 may include an opening 75 (reception opening) to receive the light source module 10 therein.

As described above, the body 30 may include the mounting plate 33 which may support various components of the lighting apparatus 100 including the light source module 10, the reflector 40, the electric unit 60, among other components. Since the operational performance of the light source module 10 may depend on its operating temperature, the body 30 may be formed of a thermally conductive material such as metal to allow rapid dissipation of heat generated by the LED 11 of the light source module 10.

Moreover, the body 30 may be provided at the outer surface thereof with a plurality of radiator fins 35. The radiator fins 35 may be radially spaced apart from one another by a predetermined distance. The plurality of radiator fins 35 may increase a surface area of the body 30 in direct contact with air to enable effective heat dissipation. Furthermore, the arrangement of the radiator fins 35 at predetermined intervals may allow air to more easily flow between the radiator fins 35. The increased air flow may further increase heat dissipation.

The lighting apparatus 100 according to this embodiment may include a thermal conductor 15 (thermal conductor member) provided between the light source module 10 and the mounting plate 33. The thermal conductor 15 may allow a more rapid transfer of heat from the LED 11 of the light source module 10 to the heat sink 30. Moreover, a front ring 20 may be provided to hold the lens 50 in place. The front ring 20 may assist coupling of the lens 50 to the body 30. Moreover, the front ring 20 may include a plurality of vent holes 21. The vent holes 21 may be positioned a predetermined distance apart from one another to correspond to the spacing between the radiator fins 35. The vent holes 21 may allow air to freely flow between the plurality of radiator fins 35 without interference from the front ring 20.

The lighting apparatus 100 of this embodiment may include a guide plate 70. The guide plate 70 may be mounted on the mounting plate 33. The guide plate may guide the installation and positioning of the light source module 10 as well as electrically insulate the light source module 10 from the body 30. As illustrated in FIG. 2, the guide plate 70 may have a shape that corresponds to a shape of the mounting plate 33 in the body 30. When the guide plate 70 and the mounting plate 33 are shaped to correspond to each other, it may be possible to prevent the guide plate 70 from laterally moving inside the cavity 31.

The guide plate 70 may include a region provided thereon that is open from the top surface through the bottom surface. In other words, the guide plate 70 may include a hole or opening formed therethrough. This opening 75 may be configured to receive the light source module 10 and may guide the installation of the light source module 10. For example, the opening 75 may be formed to have a shape that corresponds to a shape of the light source module 10. Hence, the light source module 10 may be easily positioned in the lighting apparatus 100 through the use of the opening 75 on the guide plate 70.

The lighting apparatus 100 of this embodiment may include at least one first fastening element 91. The first fastening element 91 may simultaneously couple the guide plate 70 and the light source module 10 to the body 30. At least one first fastening hole 71 that corresponds to the first fastening element 91 may be provided on the guide plate 70 and the light source module 10. Moreover, the lighting apparatus 100 of this embodiment may include at least one second fastening element 92 that may couple the guide plate 70 to the body 30. The guide plate 70 may include a second fastening hole 72 that corresponds to the second fastening element 92. The guide plate 70, the first and second fastening elements 91, 92 and the first and second fastening holes 71, 72 are described in further detail with reference to FIG. 3 hereinbelow.

Figure 3A:
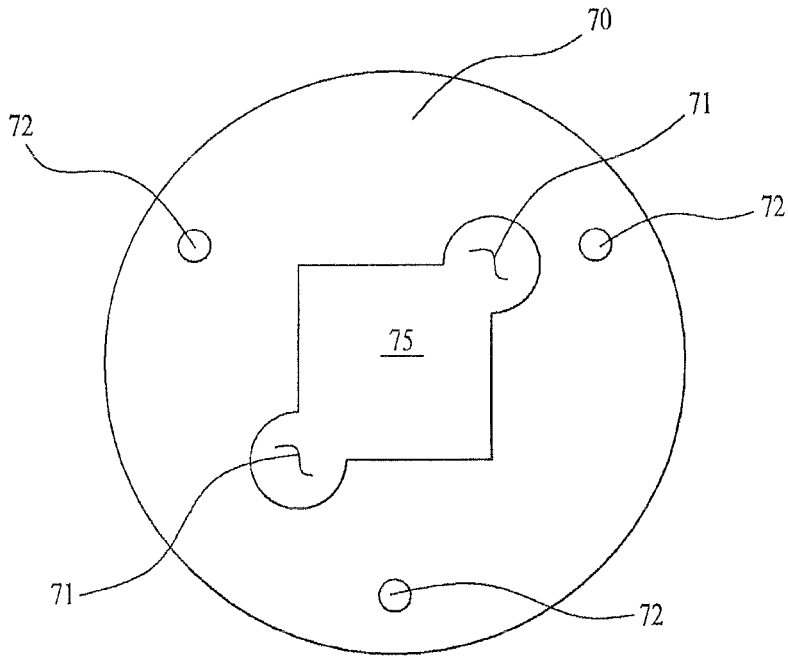
FIG. 3 is a plan view of a guide plate and a light source module of the lighting apparatus according to an embodiment of the present disclosure.
Figure 3B:
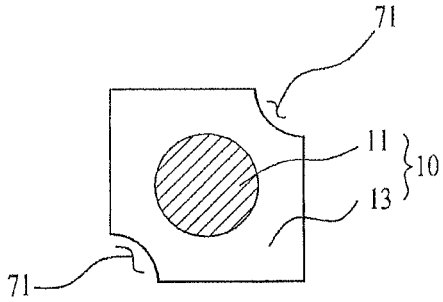

FIG. 3 is a plan view of the guide plate and the light source module of the lighting apparatus according to an embodiment of the present disclosure. FIG. 3A is a plan view of the guide plate 70, and FIG. 3B is a plan view of the light source module 10 according to this embodiment of the present disclosure.

As illustrated in FIG. 3, the light source module 10 of this embodiment may include an LED 11 and a circuit board 13 on which the LED 11 may be mounted. Both the guide plate 70 and the circuit board 13 may include a portion of the at least one first fastening hole 71 through which the first fastening element 91 may be inserted. The first fastening element 91 may then simultaneously couple the guide plate 70 and the light source module 10 to the mounting plate 33. For example, the first fastening hole 71 may be positioned on a portion of the guide plate 70 and a portion of the circuit board 13 that correspond to each other when the circuit board 13 is mounted on the guide plate 70. Hence, the first fastening hole 71 may be formed to have a shape that corresponds to a shape of the first fastening element 91 when the light source module 10 is placed in the opening 75 of the guide plate 70.

In other words, the circuit board 13 may have a prescribed shape and the opening 75 on the guide plate 70 may have a shape that corresponds to the shape of the circuit board 13. The circuit board 13 may include a recess formed laterally from a side edge of the circuit board 13, and the guide plate 70 may include a recess formed laterally from a side edge of the opening 75 that corresponds to the recess on the circuit board 13. When the light source module 10 is assembled in the guide plate 70, the two recesses may form the first fastening hole 71 that may span both the circuit board 13 as well as the guide plate 70.

Moreover, in this embodiment, the circuit board 13 and the opening 75 may be formed to have a square or rectangular shape. In this case, the first fastening hole 71 may be provided at a corner of the circuit board 13 and the opening 75. Furthermore, a height of the circuit board 13 and a height of the guide plate 70 may be substantially the same. For example, when assembled on the mounting plate 33, a top surface of the circuit board 13 may be coplanar with a top surface of the guide plate 70. The fastening element 91 may be inserted into the first fastening hole 71 to simultaneously couple both the guide plate 70 and the light source module 10 to the body 30 in a state in which the light source module 10 is seated in the opening 75 of the guide plate 70.

As shown in FIGS. 3A and 3B, a first fastening hole 71 may be formed at two opposing diagonal corners of the light source module 10 and the opening 75. When the light source module 10 of FIG. 3B is placed in the opening 75 of the guide plate 70 of FIG. 3A, the portion of the first fastening hole 71 formed at a lower left corner of the opening 75 and the portion of the first fastening hole 71 formed at a lower left corner of the circuit board 13 may combine to form a shape that corresponds to the cross-section of the first fastening element 91.

Moreover, as shown in FIG. 2, the first fastening element 91 may be a screw having a head. In this case, when the first fastening element 91 is inserted through the first fastening hole 71 to be screwed into the mounting plate 33, the head may simultaneously compress a surface near the two edges of the circuit board 13 at the corner where the first fastening hole 71 is positioned. Hence, the light source module 10 may be more securely fixed to the body 30. While the first fastening element 91 is disclosed herein as being a screw, it should be appreciated that other appropriate types of connectors may be used, for example, a rivet or bolt.

As previously discussed, the opening 75 may have a shape that corresponds to a shape of the light source module 10 such that the light source module 10 may be inserted in the opening 75 of the guide plate 70. While the shape of the light source module 10 is disclosed herein as having a square or rectangular shape, it should be appreciated that the light source module 10 and the corresponding opening 75 may be formed to have any suitable shape.

Moreover, the shape and size of the opening 75 and the light source module 10 may be formed such that the light source module 10 may be friction fitted in the opening 75. In this case, the light source module 10 may be stably held in place while the first fastening element 91 is secured. In another embodiment, the light source module 10 may be secured inside the opening 75 by a thermally conductive adhesive. For example, the thermal conductor 15 may include an adhesive which may secure the light source module 10 on the mounting plate 33 inside the opening 75.

The guide plate 70 may include at least one second fastening hole 72 through which the second fastening element 92 may be inserted to couple the guide plate 70 to the body 30. The second fastening element 92 may allow the guide plate 70 to be coupled to the body 30 prior to being assembled with the light source module 10. As illustrated in FIG. 3A, the second fastening hole 72 may be positioned on the guide plate 70, outside of the opening 75.

Figure 4:
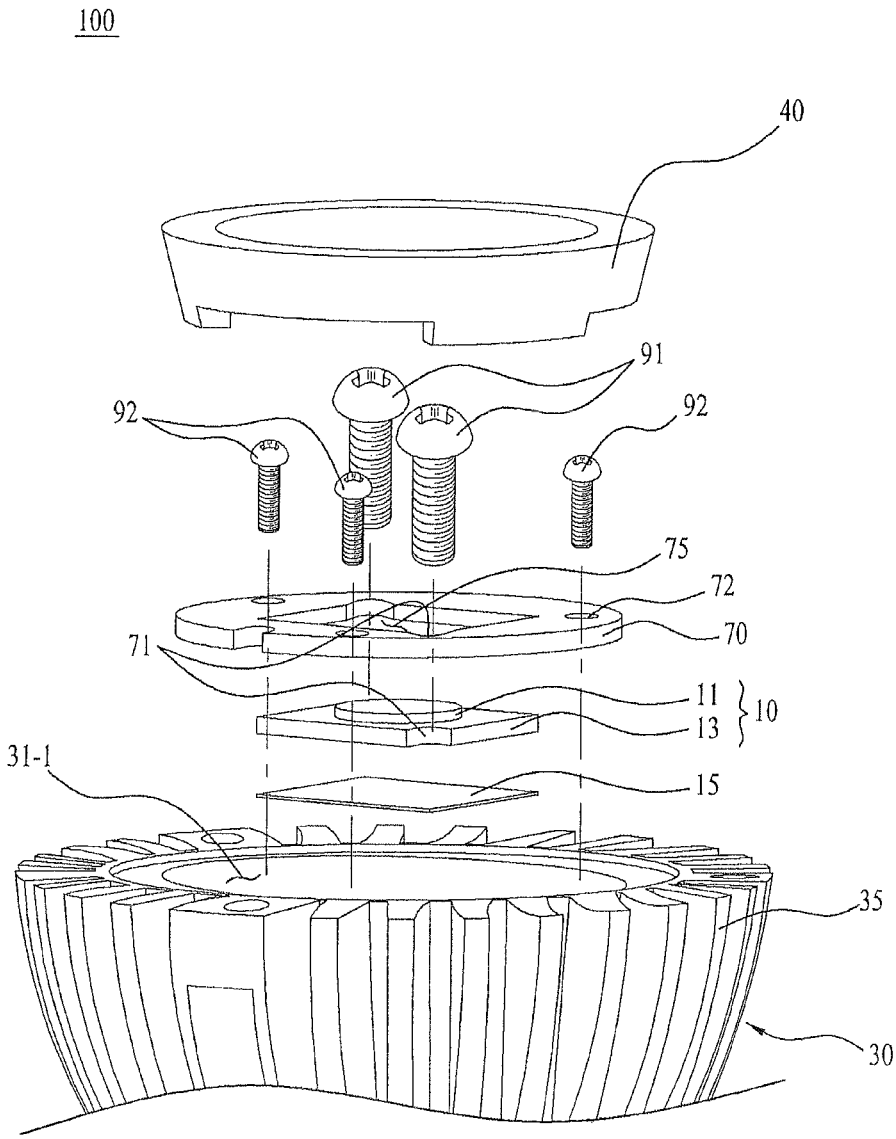
FIG. 4 is an exploded perspective view of the lighting apparatus according to an embodiment of the present disclosure.
Figure 5:
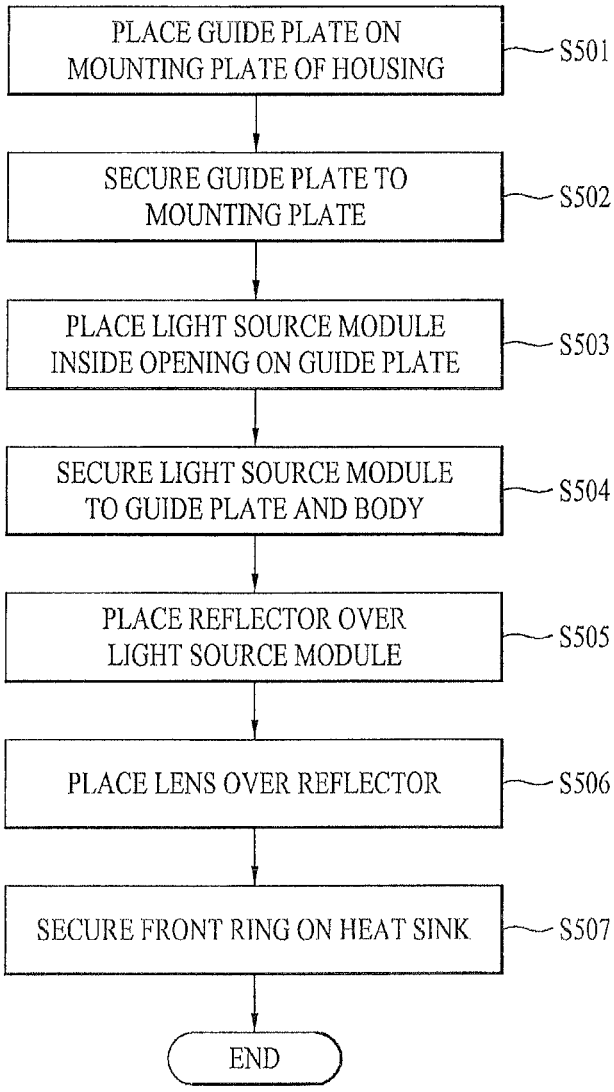
FIG. 5 is a flowchart of a method of coupling the light source module to the body.

FIG. 4 is an exploded perspective view of the lighting apparatus according to the embodiment of the present disclosure. FIG. 5, is a flowchart of a method of coupling the light source module to the body. Referring to FIGS. 4 and 5, the guide plate 70 may be placed on the mounting plate 33 in the upper cavity 31-1 of the body 30, in step S501. The guide plate 70 may have a shape that corresponds to a shape of the mounting plate 33, and thus, may be positioned such that it is not easily separated from the cavity 31 of the body 30. The second fastening element 92 may be inserted through the second fastening hole 72 formed in the guide plate 70 to couple the guide plate 70 to the body 30, in step S502. The second fastening element 92 may be a bolt, screw, rivet, or another appropriate type of connector.

After the guide plate 70 is mounted to the body 30, the light source module 10 may be inserted into the opening 75 of the guide plate 70, in step S503. Here, the light source module 10 may be inserted into the opening 75 such that a portion of the first fastening hole 71 on the circuit board 13 is positioned to correspond to a portion of the first fastening hole 71 on the opening 75. By coupling the guide plate 70 to the body 30 prior to installing the light source module 10, it may be possible prevent movement of the guide plate 70 while the light source module 10 is inserted into the opening 75 of the body 30. Moreover, in certain embodiments, a thermal conductor 15 may be placed in the opening 75 prior to inserting the light source module 10.

After the light source module 10 is completely inserted into the reception opening 75, the first fastening element 91 may be inserted through the first fastening hole 71 on the guide plate 70 and the light source module 10 to couple the light source module 10 to the body 30, in step S504. The first fastening element 91 may be a bolt, screw, rivet, or another appropriate type of connector. When installed, the first fastening element 91 may simultaneously compress both the light source module 10 and the guide plate 70 to couple both to the body 30. This may provide a more stable assembly of the lighting device 100.

After the light source module 10 is secured, the reflector 40 may placed over the light source module 10, in step S505. Thereafter, the lens 50 may be placed over the reflector 40, in step S506. The flange 53 of the lens 50 may be placed on a recess formed at the top edge of the upper cavity 31-1 of the heat sink 30. The recess may have a shape that corresponds to the shape of the flange 53. The front ring 20 may then be secured on the heat sink 30 over the lens 50 to complete the assembly of the lighting apparatus 10, in step S507. A connector 23, as shown in FIG. 2, may be used to secure the front ring 20 to the heat sink 30. The connector 23 may also be connected from the body 30 to the bottom surface of the front ring 20 such that the connector 23 is not visible on the top surface of the front ring 20.

Figure 6:
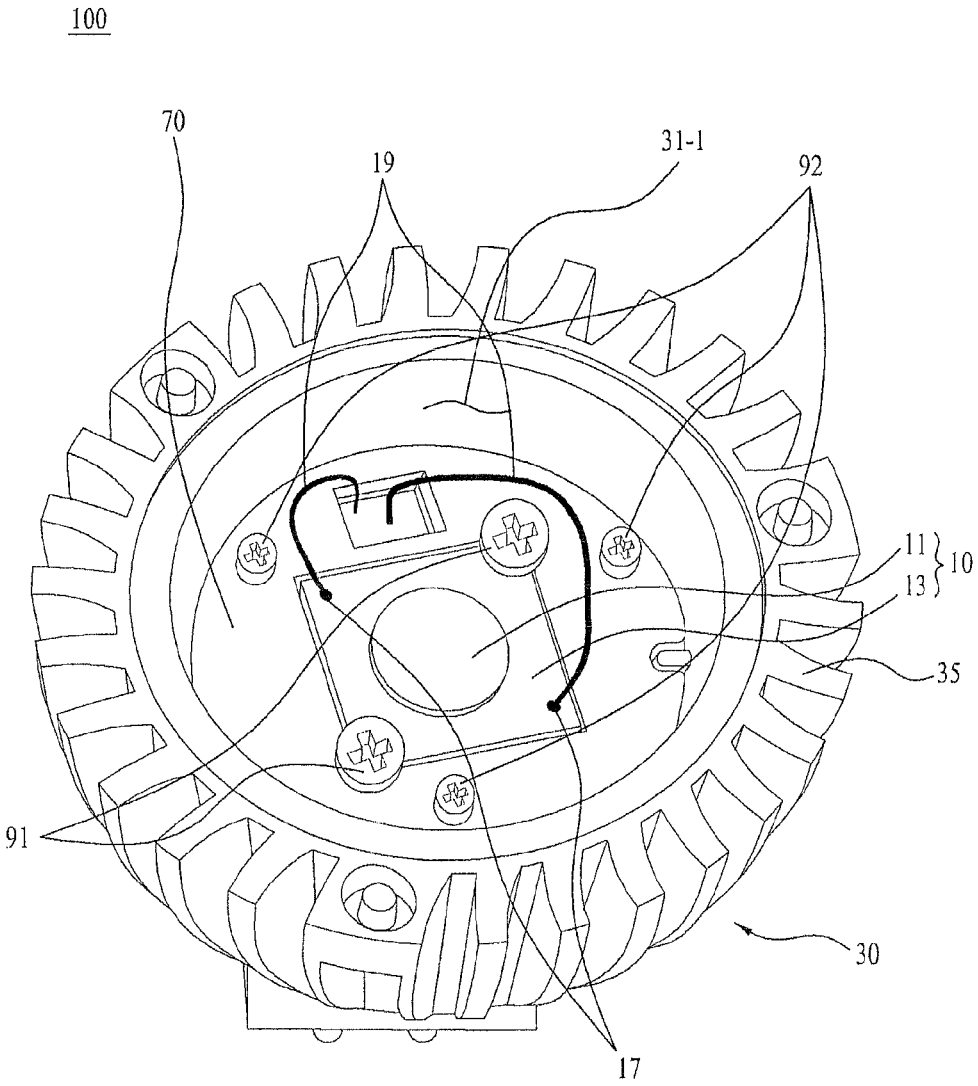
FIG. 6 is a perspective view of the lighting apparatus according to an embodiment of the present disclosure.

FIG. 6 is a perspective view of the lighting apparatus according to an embodiment of the present disclosure. Referring to FIG. 6, the guide plate 70 provided in the lighting apparatus 100 may assist coupling of the light source module 10 as previously described. In addition, the guide plate 70 may prevent an unintentional electrical connection between the light source module 10 and the body 30. To this end, the guide plate 70 may be made of an insulating material. More specifically, the guide plate 70 may be made of a polycarbonate resin, Acrylonitrile Butadiene Styrene (ABS) resin or another appropriate type of insulating material.

The light source module 10 may include one or more electrodes 17 provided on the circuit board 13 on which the LED 11 is mounted. The lighting apparatus 100 may further include an electrode connector 19 to electrically connect the electrode 17 on the circuit board 13 to the electric unit 60. That is, the light source module 10 may require power or control signals from the electric unit 60 for operation. The electrode 17 may be provided on the circuit board 13 of the light source module 10 to supply power or to carry control signals from the electric unit 60 to the light source module 10.

In this embodiment as shown in FIG. 6, the electrode connector 19 may be an electrical wire. In this case, the electrode connector 19 may be soldered to the electrode 17. However, when connecting the electrode 17 to the electrode connector 19, faulty soldering may cause the solder to overflow around the electrode 17 and onto the circuit board 13. In this case, the solder may reach the body 30 which may be made of metal to cause the light source module 10 and the electric unit 60 to be electrically connected to the metallic body 30. Consequently, the short circuit may cause an electric shock or otherwise deteriorate the performance of the lighting apparatus 100.

Hence, the lighting apparatus 100 of this embodiment, as illustrated in FIG. 6, may include the guide plate 70 configured to receive the light source module 10 in the opening 75 thereof. Because the guide plate 70 may be formed of an electric insulator, the light source module 10 may be insulated from the metallic body 30. Therefore, even in case where a faulty solder joint causes the solder to overflow from the light source module 10 onto the guide plate 70, it may be possible to prevent an electrical connection between the light source module 10 and the body 30. Moreover, to enhance the insulation function, the guide plate 70 may be formed of a polycarbonate resin and/or a Acrylonitrile Butadiene Styrene (ABS) resin, as described above.

As should be apparent from the above description, the present disclosure provides the following effects and/or advantages. A lighting apparatus as embodied and broadly disclosed herein may include an installation guide plate in which a light source unit (light source module) may be received. Thus, the lighting apparatus may allow the light source unit to be easily coupled to an apparatus body and may result in enhanced assembly efficiency. Furthermore, in the lighting apparatus according to the present disclosure, the installation guide member may prevent unintentional electrical connections between the light source unit and the electric unit, thereby improving the electrical insulation of the components.

The lighting apparatus as disclosed herein may include a light source unit including a light-emitting element, a body that may include a receiving space defined in the body and a seating plane portion that may divide the receiving space into an upper region and a lower region. The light source unit may be mounted on the seating plane portion in the upper region and an electric unit may be located in the lower region of the receiving space. An installation guide member may be mounted on the seating plane portion and may have a reception opening to receive the light source unit therein.

The light source unit may further include a circuit board on which the light-emitting element may be mounted. The installation guide member and the circuit board may respectively have at least one first fastening hole, through which a first fastening element may penetrate to simultaneously couple the installation guide member and the light source unit to the body.

The first fastening hole may be perforated in corresponding positions of the installation guide member, and the circuit board may have a shape corresponding to the first fastening element. The first fastening holes may be perforated in a corner of the circuit board and a corner of the reception opening which correspond to the corner of the circuit board. The installation guide member may have at least one second fastening hole through which a second fastening element may penetrate to couple the installation guide member to the body.

The reception opening may have a shape that corresponds to the light source unit. The installation guide member may be made of an insulating material. For example, the installation guide member may be made of polycarbonate resin or Acrylonitrile Butadiene Styrene (ABS) resin.

The light source unit may further include a circuit board on which the light-emitting element may be mounted and an electrode may be provided on the circuit board. The lighting apparatus may further include an electrode connector to electrically connect the electrode of the circuit board to the electric unit. The electrode connector may be connected to the electrode by solder. Moreover, the body may be made of metal. The light-emitting element may be a Light Emitting Diode (LED).

Moreover, the body may be provided at an outer surface thereof with a plurality of radiator fins that may be radially spaced apart from one another by a predetermined distance. The lighting apparatus may further include a lens unit which may redirect light emitted from the light-emitting element to an outside. The lighting apparatus may further include a reflection member which may reflect light emitted from the light-emitting element in a predetermined direction.

In accordance with another aspect of the present disclosure, a lighting apparatus may include a light source unit configured to emit light, a body including a seating plane portion on which the light source unit is mounted, and an installation guide member mounted on the seating plane portion, which may serve not only to guide installation of the light source unit, but also to insulate the light source unit from the body. The body may be made of a metal.

In accordance with a further aspect of the present disclosure, a lighting apparatus may includes a light source unit including a light-emitting element, an electric unit which may drive the light source unit upon receiving power from an external source, and a body to cover the light source unit and the electric unit therein. The body may include a seating plane portion on which the light source unit may be mounted. An installation guide member may be mounted on the seating plane portion and may include an opening to insert the light source unit therein. The opening of the installation guide member may have a size that corresponds to a size of the light source unit. Moreover, the installation guide member may be made of an insulating material.

A lighting apparatus as embodied and broadly disclosed herein may include a light source including at least one LED provided over a substrate, the substrate having a first prescribed shape; a body having a first cavity and a second cavity, wherein the light source is provided in the first cavity; an electric unit positioned in the second cavity; and a guide plate provided in the first cavity and having a region, the region having a second prescribed shape, the first and second prescribed shapes having prescribed dimensions to allow the substrate to be mounted in the region.

The prescribed dimensions may allow friction fitting between the substrate and the region of the guide plate. In the lighting apparatus, an adhesive may be provided between the light source and the body to secure the light source to the body. Moreover, the guide plate may include at least one first recess, wherein a connector which may be positioned at the at least one first recess may secure both the light source and the guide plate to the body.

In the lighting apparatus of this embodiment, the light source may include at least one second recess positioned adjacent to the at least one first recess, wherein the connector may be a screw, and the at least one first recess on the guide plate and the at least one second recess on the light source form a hole for the screw. Moreover, the at least one second recess may be formed at a corner of the substrate and the at least one first recess on the guide plate may be formed at a corner of the region, wherein the corner of the region corresponds to the corner of the substrate.

In this lighting apparatus, the region may have a shape that corresponds to a shape of the substrate. Furthermore, the guide plate may be formed of an insulating material. For example, the guide plate may be formed of a polycarbonate resin or an Acrylonitrile Butadiene Styrene (ABS) resin. The substrate may be a circuit board having an electrode, wherein an electrical connector may be soldered to the electrode to connect the electrode to the electric unit.

The body may be formed of a metal. Moreover, the body may be a heat sink having a plurality of radiator fins positioned a predetermined distance from each other. Moreover, the lighting apparatus may further include a lens provided over the first cavity configured to project light emitted from the light source in a predescribed direction and a reflector configured to redirect light emitted from the light source in a predescribed direction.

In another embodiment, a lighting apparatus as broadly disclosed herein may include a light source configured to emit light; a body including a surface on which the light source is mounted; and a guide plate mounted on the surface of the body. The guide plate may be configured to guide a positioning of the light source, wherein the guide plate may be formed of an electrically insulating material that electrically insulates the light source from the body. In this embodiment, the body may be formed of a metal.

In yet anther embodiment, a lighting apparatus as broadly disclosed herein may include a light source module including a light-emitting element; an electric unit configured to drive the light source upon receiving power from an external power source; a body configured to house the light source and the electric unit, wherein the body may include a mounting surface on which the light source module is mounted; and a guide plate mounted on the mounting surface, wherein the guide plate may have an opening that receives the light source module. In this embodiment, the opening on the guide plate may have a shape that corresponds to a shape of the light source module. Moreover, the guide plate may be formed of an insulating material.

Examples of a lighting apparatus are disclosed in application Ser. No. 13/049,771, which is hereby incorporated by reference.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a light source including at least one LED provided over a substrate, the substrate having a first prescribed shape and the light source including one or more electrodes provided on the substrate on which the at least one LED is provided;

a body having a first cavity and a second cavity and a plurality of radiator fins positioned a distance from each other, the body including a mounting plate to divide the body into the first cavity and the second cavity, wherein the light source is provided in the first cavity;

an electric unit positioned in the second cavity, the electric unit including a power connector to be connected an external power;

a base positioned at the second cavity to surround the electric unit;

an electrical wire connected to the electric unit and the one or more electrodes;

an alignment plate provided in the first cavity and having a planar surface and an opening formed through the planar surface of the alignment plate, the opening having a second prescribed shape, the first and second prescribed shapes having prescribed dimensions to allow the substrate to be mounted in the opening;

a first fastening element to fasten the alignment plate and the mounting plate and the base, the first fastening element placed through the planar surface of the alignment plate and the mounting plate;

a second fastening element to simultaneously couple the alignment plate and the substrate of the light source, wherein the substrate is placed in the opening such that the planar surface of the alignment plate is substantially parallel to a top surface of the substrate, and wherein the electrical wire is routed through the mounting plate and the alignment plate to connect the electric unit to the one or more electrodes, wherein the alignment plate and the substrate make contact with the mounting plate, respectively, wherein a hole formed between an inner side surface of the opening and an outer surface of the substrate, and wherein the second fastening element positioned at the hole secures both the substrate and the planar surface of the alignment plate to the mounting plate.

2. The lighting apparatus of claim 1, wherein the prescribed dimensions allow friction fitting between the substrate and the opening of the alignment plate.

3. The lighting apparatus of claim 1, wherein an adhesive is provided between the light source and the body to secure the light source to the body.

4. The lighting apparatus of claim 1, wherein the alignment plate includes at least one first recess formed at a side surface of the opening, wherein the second fastening element positioned at the at least one first recess secures both the substrate and the alignment plate to the body.

5. The lighting apparatus of claim 4, wherein the substrate includes at least one second recess positioned adjacent to the at least one first recess.

6. The lighting apparatus of claim 5, wherein the second fastening element is a screw, and the at least one first recess on the alignment plate and the at least one second recess on the substrate form the hole for the screw.

7. The lighting apparatus of claim 6, wherein the at least one second recess is formed at a corner of the substrate and the at least one first recess on the alignment plate is formed at a corner of the opening, wherein the corner of the opening corresponds to the corner of the substrate.

8. The lighting apparatus of claim 1, wherein the opening has a shape that corresponds to a shape of the substrate.

9. The lighting apparatus of claim 1, wherein the alignment plate is formed of an insulating material.

10. The lighting apparatus of claim 9, wherein the alignment plate is formed of a polycarbonate resin or an Acrylonitrile Butadiene Styrene (ABS) resin.

11. The lighting apparatus of claim 9, wherein the electrical wire is soldered to the electrode to connect the electrode to the electric unit.

12. The lighting apparatus of claim 9, wherein the body is formed of a metal.

13. The lighting apparatus of claim 1, further comprising a lens provided over the first cavity configured to project light emitted from the light source in a predescribed direction.

14. The lighting apparatus of claim 1, further comprising a reflector configured to redirect light emitted from the light source in a predescribed direction.

* * * * *